US006098943A

United States Patent [19]

Howard et al.

[11] Patent Number: 6,098,943

[45] Date of Patent: Aug. 8, 2000

[54] WALL MOUNT MOTION SWITCH CLIP-ON MOUNTING BRACKET

[75] Inventors: Carol Z. Howard, Oxford; Ward E. Strang, Fairfield, both of Conn.

[73] Assignee: Hubbell Incorporated, Orange, Conn.

[21] Appl. No.: 09/192,346

[22] Filed: Nov. 16, 1998

[51] Int. Cl.[7] ..... F21V 21/30

[52] U.S. Cl. ..... 248/231.81; 362/394; 362/276; 362/802; 362/368; 362/370

[58] Field of Search ..... 248/231.81, 290.1, 248/316.7, 310, 311.2, 304, 339; 362/271, 419, 394, 382, 272, 277, 278, 276, 368, 370, 802, 147, 396; 220/481, 483

[56] References Cited

U.S. PATENT DOCUMENTS

| | | | |
|---|---|---|---|
| 2,754,991 | 7/1956 | Hagerty et al. | 220/481 |
| 3,193,232 | 7/1965 | Hatcher | 248/231.81 |
| 4,497,118 | 2/1985 | Byrum | 33/366.2 |
| 4,914,422 | 4/1990 | Rosenfield et al. | 340/573.1 |
| 5,258,899 | 11/1993 | Chen | 362/394 |
| 5,381,323 | 1/1995 | Osteen et al. | 362/276 |
| 5,523,644 | 6/1996 | Witehira | 310/329 |
| 5,649,761 | 7/1997 | Sandell et al. | 362/276 |
| 5,662,411 | 9/1997 | Haslam et al. | 362/276 |
| 5,790,040 | 8/1998 | Krier et al. | 340/693.1 |

*Primary Examiner*—Anita M. King
*Assistant Examiner*—Naschica Sanders

[57] ABSTRACT

An arrangement for mounting a unit incorporating a lighting control motion switch therein to either a wall or to a ceiling. Disclosed is the mounting of a unit housing the lighting control motion switch to either a wall or ceiling through the intermediary of a novel clip-on mounting bracket, subsequent to securing the clip-on bracket to the wall or ceiling. In order to provide the novel mounting arrangement for readily mounting the entire unit to either a ceiling or to a wall, there is provided the clip-on bracket structure which includes an inverted U-shaped element adapted to be inserted through a recess formed in the back of the back housing portion and to pass upwardly through an aperture in the upper end of the recess into contact with the inner surface of the rear wall thereof. A detent is formed on either the bracket or the rear wall of the housing, and is adapted to be engaged by a protrusion, so as to latch the entire unit into fixed engagement on the clip-on mounting bracket, while enabling the front housing portion to be pivotably adjusted as may be required by the particular intended physical application.

8 Claims, 1 Drawing Sheet

WALL MOUNT MOTION SWITCH CLIP-ON MOUNTING BRACKET

BACKGROUND OF THE INVENTION

1. Field of the Invention

The present invention relates to an arrangement for mounting a unit incorporating a lighting control motion switch therein to either a wall or to a ceiling. Particular, the invention relates to the mounting of the unit housing the lighting control motion switch to either a wall or ceiling through the intermediary of a novel clip-on mounting bracket, subsequent to securing the clip-on bracket to the wall or ceiling.

Generally, as is presently known in this technology, housing units of the type incorporate or contain motion detectors and/or lighting control motion switches which are adapted to detect any motion taking place within specified spatial sectors, such as within a room or chamber, an office, a warehouse, a hallway, or exterior areas extending about a residence, industrial or commercial facility.

Normally, the unit may contain a back housing portion and a front housing portion, wherein the front housing portion is ordinarily articulated to or hingedly connected with the back housing portion so as to be pivotable in essentially universal directions; in essence, upward and downward and/or swiveled sideways so as to be able to sense or scan the specified spatial sector for any detectable motion, while mounted on either a wall or a ceiling. In order to attain that effect, the back housing portion is generally fastened to the surface of the wall or ceiling at a predetermined location thereon as may be necessary for any particular physical or functional application.

In some instances of use, it may be expedient that rather than mounting the unit directly to a wall or a ceiling, this mounting is effected through the interposition of a bracket structure which is fixedly attached to the wall or ceiling at a specified location, and whereby the unit containing the motion detector and/or the lighting control motion switch is attached to the bracket so as to be easily assembled therewith, and reversely, easily removed or disassembled therefrom without having to loosen or remove any separate fastener elements or the like.

2. Discussion of the Prior Art

Sandell, et al., U.S. Pat. No. 5,649,761 discloses a motion detector with a side-pivoting flood light fixture, and wherein a housing supporting the motion detector and flood lights is directly fastened to a wall or the like surface through the intermediary of fastener elements. This necessitates traversing through the wall and the fixture by means of screw-type fastener elements.

Chen, et al., U.S. Pat. No. 5,258,899, is similar to the above-identified Sandell, et al. patent, and also includes plate structure which is fastenable to a wall or ceiling by means of fastener elements, and which supports swiveling flood lights and motion sensing devices.

Byrum, U.S. Pat. No. 4,497,118 discloses a motion and orientation sensor, wherein the sensor arrangement is fastened to a planar surface, such as a wall or a ceiling, through the use of fastener elements extending through the arrangement and the wall.

All of the foregoing arrangements necessitate the mounting of motion detector units or lighting control motion switches through the intermediary of fastener elements which are directly attached to the unit rather than by enabling the unit to be wall-mounted by being suspended from a bracket which is secured to the wall or ceiling so as to be installable in an easily implemented manner, and when required, dismounted from the bracket without having to detach the bracket from the wall or ceiling.

SUMMARY OF THE INVENTION

In order to attain the foregoing novel arrangement for wall mounting a lighting control switch or motion detector, pursuant to the present invention the lighting control motion switch or motion detector unit is equipped with a housing structure comprising a front housing portion which contains or houses the operative components, such as a printed circuit board, a lens array and other operative sensor structure required to implement the sensing or scanning of any motion detected within a specified spatial sector. The front housing portion is pivotably attached to a back housing portion, the latter of which has a flat rear surface and may be equipped with suitable pivot joint structure to enable the rotation of the front housing relative to the back housing so as to be able to orient the front housing in predetermined spatial relationships for the sensing or scanning of motion within specified sectors.

In order to provide the novel mounting arrangement for readily mounting the entire unit to either a ceiling or to a wall, there is provided a clip-on bracket structure which includes a U-shaped element adapted to have a leg member inserted through a recess formed in the back of the back housing portion and to pass upwardly through an aperture in the upper end of the recess into contact with the inner surface of the rear wall thereof. A detent is formed in either the bracket or the rear wall of the housing, and is adapted to be engaged by a protrusion, so as to latch the entire unit into fixed engagement on the clip-on mounting bracket, while enabling the front housing portion to be pivotably adjusted as may be required by the particular intended physical application.

Conversely, the unit may be removed from the bracket by simply slightly bending or flexing the unit forward, and then pulling upward so as to disengage the detent from the protrusion and to disengage the upwardly extending leg member of the U-shaped bracket portion from its engagement with the back housing portion.

The foregoing provides a single and readily mountable and dismountable structure, as described in further detail herein below.

Accordingly, it is an object of the present invention to provide a novel arrangement for a unit comprising a lighting control motion switch or motion detector for mounting thereof on a wall or ceiling through the intermediary of a clip-on mounting bracket.

A more specific object resides in the provision of an arrangement for mounting the unit as described herein, wherein the clip-on mounting bracket includes a U-shaped clip structure, and wherein a depression or recess is formed in the surface of the back housing of the unit enabling alignment with the bracket and whereby an upwardly extending leg member of the clip-on mounting bracket as adopted to extend through an aperture formed in the upper end of the recess so as to come into engaging surface contact with the inner wall surface thereof.

Another object of the invention resides in the provision of a mounting bracket construction of the type described, wherein there is provided a detent on either the outer surface of the rear wall of the back housing portion or the facing surface of the mounting bracket, which is adapted to be engaged by a protrusion on either the mounting bracket or outer surface of the back housing portion so as to latch the unit into a releasably engaged specified mounted position on the bracket.

BRIEF DESCRIPTION OF THE DRAWINGS

Reference may now be had to the following detailed description of a preferred embodiment of the invention, taken in conjunction with the accompanying drawings; in which.

DETAILED DESCRIPTION OF A PREFERRED EMBODIMENT

Figure 2:
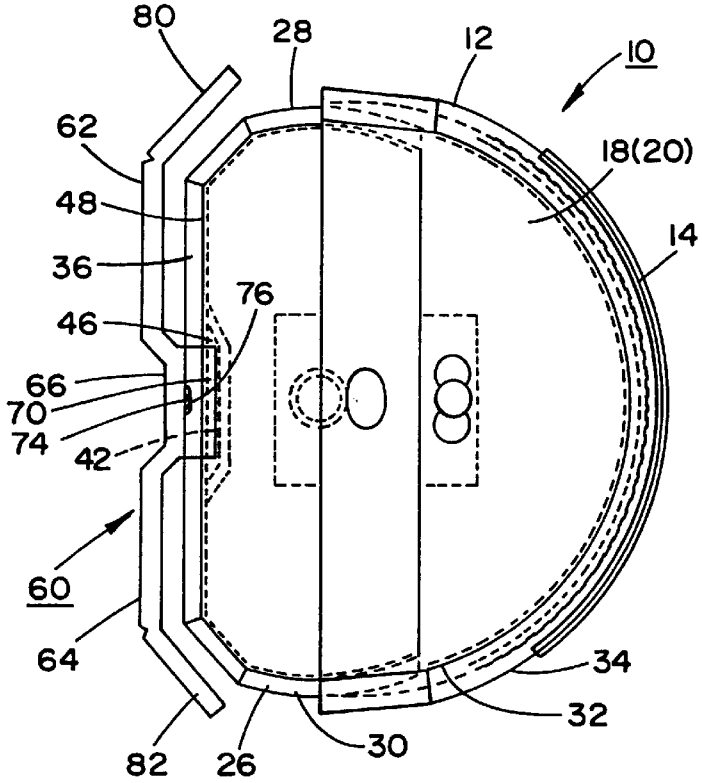
FIG. 2 illustrates a sectional view taken along line 2—2 in FIG. 1.

Referring in specified detail to the construction of the unit 10 for incorporating the lighting control motion switch or motion detector, in general this unit is quite similar in configuration with the structure disclosed in co-pending Patent Appln. No. 09/192,470 (Attorney Docket No. 911-0538; 11183). In this connection, the unit 10 comprises a front housing portion 12 which is essentially of a convex curvilinear or outwardly bowed configuration in transverse cross-section, i.e. semi-spherical as shown in FIG. 2, and which is adapted to contain the various operative components of the unit, such as the printed circuit board, lens or sensor array and/or other applicable electronic elements (not shown) providing for the sensing or scanning of any motion within a specified spatial sector so as to be able to activate a lighting control motion switch or other systems, for instance, as may be employed in detection units for security or alarm systems and the like.

In this connection, the front housing portion 12 of the unit 10 includes a front aperture 14 providing for visual scanning by means of the operative sensor components of the area being sensed or scanned, and optionally a further aperture 16 for a thermal sensor, and upper and lower wall portions 18, 20, including pivot structures 22, 24 at respectively the upper and lower ends enabling the front portion 12 to be pivoted horizontally and/or tilted vertically relative to a back housing portion 26.

The back housing portion 26 includes essentially curvilinear side walls 28, 30 which extend in closely spaced relationship within the inner surface 32 of the curvilinear wall 34 of the front housing portion 12 having the apertures therein, and a flat or planar rear wall 36 which is employed for mounting the entire unit 10 to either a wall or ceiling.

In this particular embodiment, the rear wall 36 of the back housing portion 26 is provided in its lower region 40 with a vertically extending depression or recess 42 which is essentially of a rectangular configuration, with the upper end 44 of the recess or depression having an elongate opening or aperture 46 formed therein providing access to the inner surface 48 of the rear wall 36 of the back housing portion 26. The upper and lower ends of the back housing portion 26 include walls 50, 52 which are, respectively, movable within the upper and lower wall portions 18, 20 of the front wall portion 12 within the limiting constraints of the pivot structures 22, 24.

Pursuant to the invention, there is provided a suitable clip-on mounting bracket 60, which may be constituted of steel, suitable metallic material or a rigid molded plastic having high-strength properties. The bracket 60 includes oppositely sideways extending arms 62, 64 which are adapted to be fastened to a wall or ceiling by means of suitable fasteners (not shown), and wherein the central portion 66 of the bracket includes a U-shaped clip structure 68, having a free forwardly offset and upwardly extending leg portion 70.

Figure 1:
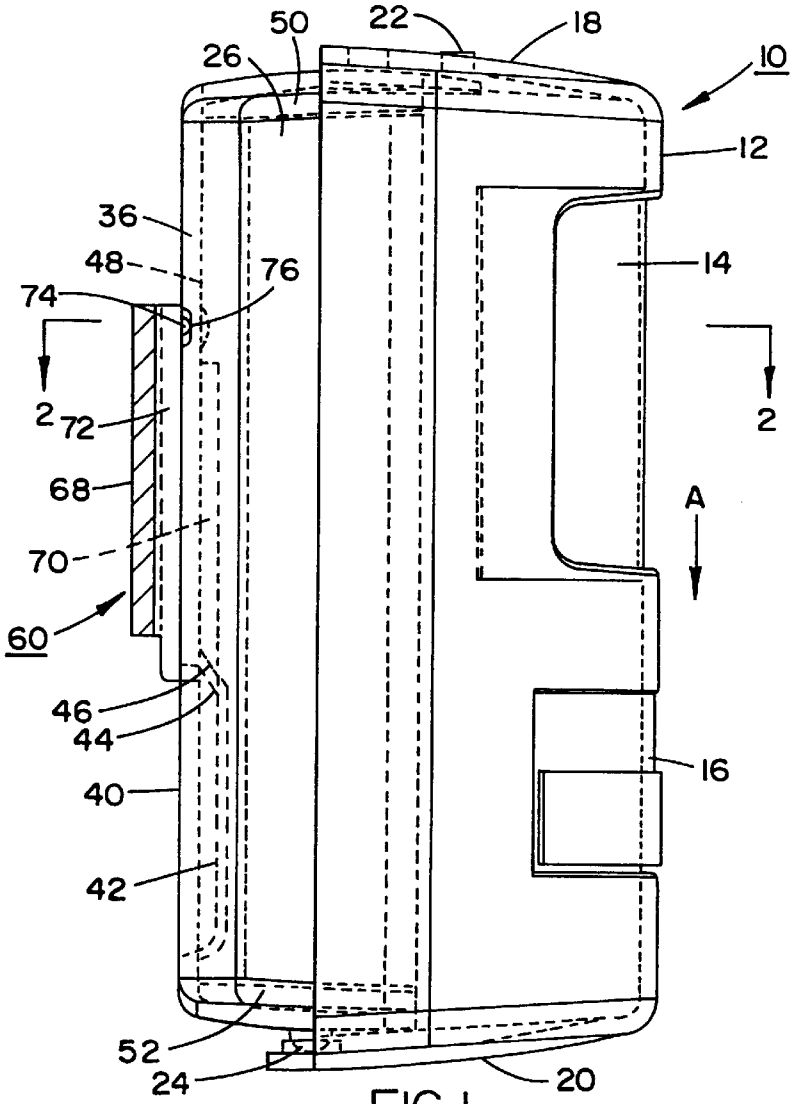
FIG. 1 illustrates, in partial section, a side elevational view of a unit containing a lighting control motion switch or motion detector, shown attached on a clip-on mounting bracket pursuant to the invention.

The U-shaped clip structure 68, which is adapted to be engaged with the back housing portion 26 for mounting the entire unit 10 to a wall or ceiling, is positionable in the depression or recess 42 which is formed in the rear wall 36 at the lower region 40 of the back housing portion 26. In order to mount the unit 10 on the bracket 60, the unit 10 is then pushed downwardly along the direction of arrow A to assume the position shown in FIG. 1, in which the upwardly extending leg portion 70 of the U-shaped bracket clip structure 68 which is located in recess 42 slides upwardly through the aperture 46 into surface contact with the inner surface 48 of the rear wall 36 of the back housing portion 26.

Concurrently, an outer or opposite leg portion 72 of the U-shaped bracket clip structure 68, facing the outer surface of the rear wall 36 of the back housing portion 26 may be provided with a suitable protrusion 74 which engages into a detent 76 formed in the outer surface of the back housing portion 26 when the unit 10 is fully seated on the U-shaped bracket structure 68 of the clip-on bracket 60. This will provide cooperative latching structures 74, 76 preventing the inadvertent displacement of the mounted unit 10 from the mounting bracket 60. Conversely, the protrusion 74 may be formed on the rear wall of the back housing portion, and the detent 76 in the leg portion 72 of bracket structure 68.

When it is desired to detach and remove the unit 10 from the wall or ceiling, it is merely necessary to apply a slight forward pulling action to the upper end of the housing 10, so as to essentially disengage the protrusion 74 and the detent 76, in view of the slight flexibility of the material of the clip structure 68 of the clip-on mounting bracket 60, and to then pull the unit 10 upward so that the upward projecting forward leg portion 70 of the U-shaped structure of the bracket 60 slides out of the aperture 46 downwardly into the recess 42 formed in the rear wall of the back housing portion, and then to merely draw the housing 10 forward so as to fully disengage from the clip-on mounting bracket 60.

When it is desired to utilize the clip-on mounting bracket 60 for wall mounting, the latter may be provided with opposite side wings 80, 82, as illustrated in FIG. 2 of the drawings; or the wings may be removed or broken off when the bracket 60 is intended for ceiling-mounting of unit 10.

The foregoing bracket structure 60 provides for a simple arrangement for detachably mounting the unit 10 containing the components for the lighting control motion switch or motion detector without having to loosen any fastener elements, and conversely, to be able to mount the unit 10 on the bracket in a simple manner without the need for any special tools or fasteners.

Although the foregoing arrangement has been described for mounting units 10 for lighting control motion switches, it is readily apparent that the unit may be a detection unit for security systems; for example, for triggering alarms in response to sensing the motion of an intruder or the like, as is well known in technology; or in connection with temperature sensors for fire alarm installations.

From the foregoing, it is readily apparent that the clip-on mounting arrangement for the unit 10 is extremely user-friendly in enabling the easy installation and/or dismounting of units on wall or ceiling mounted brackets without the need for any special tooling or fastener elements.

While there has been shown and described what is considered to be a preferred embodiment of the invention, it will, of course, be understood that various modifications and changes in form or detail could readily be made without departing from the spirit of the invention. It is, therefore, intended that the invention not be limited to the exact form and detail herein shown and described, nor to anything less than the whole of the invention herein disclosed as hereinafter claimed.

What is claimed is:

1. An arrangement for mounting a lighting control motion switch on a wall or ceiling surface; comprising:

(a) a housing unit including a front housing portion adapted to house operative components of the lighting control motion switch;

(b) a back housing portion of said housing unit being positionable within said front housing portion so as to protrude rearwardly therefrom, said back housing portion having a planar real wall, a recess being formed in said rear wall, and an aperture being formed in an upper end of said recess communicating with the interior of said back housing portion;

(c) and a bracket fastenable to said mounting surface, said bracket including upwardly projecting clip structure locatable in said recess and extendable through said aperture in said recess and so as to attach said housing unit to said bracket, said projecting clip structure including a first upstanding leg member which forms a U-shape with a second upstanding leg member at the central portion of said bracket, and said bracket including a detent formed on a surface of said second upstanding leg member facing said planar rear wall which is engageable in a depression formed in said planar rear wall upon said housing unit being mounted on said bracket for latching said housing unit to said bracket.

2. An arrangement for mounting a lighting control motion switch on a wall or ceiling surface; comprising:

(a) a housing unit including a front housing portion adapted to house operative components of the lighting control motion switch;

(b) a back housing portion of said housing unit being positionable within said front housing portion so as to protrude rearwardly therefrom, said back housing portion having a planar rear wall, a recess being formed in said rear wall, and an aperture being formed in an upper end of said recess communicating with the interior of said back housing portion;

(c) and a bracket fastenable to said mounting surface, said bracket including upwardly projecting clip structure locatable in said recess extendable through said aperture in said recess so as to attach said housing unit to said bracket, said projecting clip structure including a first upstanding leg member which forms a U-shape with a second upstanding leg member at the central portion of said bracket, said bracket including a depression formed in a surface of said second upstanding leg member facing said planar rear wall which has a detent formed on said planar rear wall engaged therein upon said housing unit being mounted on said bracket for latching said housing unit to said bracket.

3. An arrangement as claimed in claim 1 or 2, wherein said recess is formed in a lower region of said planar rear wall.

4. An arrangement as claimed in claim 3, wherein said projecting clip structure is upwardly extendable through said aperture into contact with an inner surface of said planar rear wall upon said housing unit being lowered onto said projecting clip structure so as to be attached to said bracket.

5. An arrangement as claimed in claim 1 or 2, wherein said projecting clip structure is integrally formed with said bracket.

6. An arrangement as claimed in claim 1 or 2, wherein said bracket includes laterally extending arm portions rearwardly of said back housing portion.

7. An arrangement as claimed in claim 6, therein said laterally extending arm portions have wing structures extending from the opposite free ends thereof.

8. An arrangement as claimed in claim 1 or 2, wherein said front housing portion is articulated to said back housing portion so as to be pivotable relative thereto, said front housing portion having an aperture to facilitate the scanning of spatial sectors by any operative components which are housed in said housing unit.

* * * * *